US006639503B2

(12) United States Patent
Rhodes et al.

(10) Patent No.: US 6,639,503 B2
(45) Date of Patent: Oct. 28, 2003

(54) METHODS AND APPARATUS FOR MOUNTING A BIMETAL COIL IN A THERMOSTAT

(75) Inventors: William D. Rhodes, St. Louis, MO (US); Bartholomew L. Toth, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 20 days.

(21) Appl. No.: 10/093,298

(22) Filed: Mar. 7, 2002

(65) Prior Publication Data

US 2003/0169145 A1 Sep. 11, 2003

(51) Int. Cl.[7] ..... H01H 37/52; H01H 37/46; H01H 37/14

(52) U.S. Cl. ..... 337/360; 337/377; 337/333; 337/379

(58) Field of Search ..... 337/333, 344, 337/360, 377, 378, 379, 396; 29/622

(56) References Cited

U.S. PATENT DOCUMENTS

| | | | | | |
|---|---|---|---|---|---|
| 2,371,603 | A | * | 3/1945 | Bradley | 374/206 |
| 2,484,145 | A | | 10/1949 | Bader | |
| 2,587,733 | A | * | 3/1952 | Jones | 236/68 B |
| 2,905,790 | A | * | 9/1959 | Markham | 337/103 |
| 3,154,654 | A | | 10/1964 | Woods et al. | |
| 3,190,988 | A | * | 6/1965 | Graham et al. | 337/366 |
| 3,231,703 | A | * | 1/1966 | Grahl et al. | 337/338 |
| 3,249,721 | A | * | 5/1966 | Baak | 337/42 |
| 3,339,043 | A | * | 8/1967 | Baak | 337/298 |
| 3,451,027 | A | * | 6/1969 | Porter | 337/342 |
| 3,720,107 | A | * | 3/1973 | Shepard | 60/529 |
| 3,792,403 | A | * | 2/1974 | Bullock | 337/66 |
| 3,948,438 | A | | 4/1976 | Vlasak | |
| 3,975,703 | A | * | 8/1976 | Andresen, Jr. | 337/374 |
| 3,993,120 | A | * | 11/1976 | Iberg et al. | 165/261 |
| 4,114,681 | A | * | 9/1978 | Denny | 165/265 |
| 4,180,789 | A | | 12/1979 | Martucci | |
| 4,301,438 | A | | 11/1981 | McElroy | |
| 4,314,222 | A | | 2/1982 | Teichert | |
| 4,775,099 | A | * | 10/1988 | Podlipnik | 236/1 C |
| 4,919,196 | A | * | 4/1990 | Podlipnik | 165/255 |
| 5,262,752 | A | * | 11/1993 | Truong et al. | 337/373 |
| 5,732,879 | A | * | 3/1998 | Low | 236/44 R |

FOREIGN PATENT DOCUMENTS

| | | | | | |
|---|---|---|---|---|---|
| JP | 57140547 | A | * | 8/1982 | F02M/1/12 |

* cited by examiner

*Primary Examiner*—Anatoly Vortman
(74) *Attorney, Agent, or Firm*—Harness, Dickey & Pierce, P.L.C.

(57) ABSTRACT

An apparatus is described for mounting a bimetal coil in a thermostat having an anticipator operable via an anticipator circuit. The apparatus includes an insulating member configured to insulate the coil from the anticipator circuit. The apparatus also includes a conductive shaft configured for mounting the coil and anticipator thereon. The insulating member is further configured for mounting between the coil and the shaft. This apparatus allows an inner end of a bi-metal coil to be secured easily in a thermostat, thus eliminating a need for more expensive mounting methods and costly insulating parts. The apparatus also simplifies calibration while reducing costs of assembly and materials.

21 Claims, 4 Drawing Sheets

METHODS AND APPARATUS FOR MOUNTING A BIMETAL COIL IN A THERMOSTAT

FIELD OF THE INVENTION

This invention relates generally to mechanical thermostats and, more particularly, to mounting a bimetal coil in a mechanical thermostat.

BACKGROUND OF THE INVENTION

Mechanical thermostats typically utilize a bi-metal coil having an inner end secured to a fixed point and an outer end configured to move as the coil winds and unwinds in response to temperature changes. Movement of the bi-metal coil operates a contact in an electrical switch for operating the heating and/or cooling system that the thermostat controls. It is cost-effective to secure the coil by mounting it on a pin that also serves as an electrical connection for a heat anticipator circuit. In electrically isolated mercury switch thermostats, the bi-metal coil can be spot-welded to the pin. However, in snap-action thermostats in which a conductive pin is used to mount both the coil and the anticipator circuit, it is necessary to electrically isolate the contact on the bimetal coil from the pin and anticipator circuit, and so other techniques must be used to secure the contact to the bi-metal coil In at least one known thermostat, the bi-metal coil is perma-bonded to the pin, making it somewhat difficult, however, to calibrate the thermostat. In another thermostat, a conductive eyelet is placed inside the bi-metal. The eyelet then is placed over the pin, placed in a press, and crimped. The contact then is isolated from the conductive pin at a point where contact is attached to the bi-metal coil. Relative to other methods, these techniques involve more parts, greater fabrication cost and a more expensive contact assembly mounted to the thermostat base.

SUMMARY OF THE INVENTION

The present invention relates to an improved mounting for bi-metal coils and to thermostats with improved mounting of bi-metal coils. Generally, the thermostat of this invention comprises a base; a conductive shaft extending from the base; and heat anticipator circuit mounted on, and electrically connected to, the conductive shaft. In accordance with the principles of this invention, an electrically insulative member is mounted on the conductive shaft between the base and the anticipator circuit. A temperature-responsive element, such as a bi-metal coil, is mounted on the electrically insulative member electrically isolated from the conductive shaft and anticipator circuit. The element carries a conductive switch member.

The insulative member preferably has a bore therethrough configured to engage the shaft and resist rotation. For example, at least a portion of the shaft and a portion of the bore through the insulative member have mating configurations to resist relative rotation. The insulative member preferably also has an external surface adapted to engage the end of the coil and resist rotation of the coil. For example, the insulative member can have a plurality of longitudinally extending ridges and valleys on the surface to engage the end of the coil and resist relative rotation.

In the preferred embodiment, the insulative member has a flange adjacent one end of the insulative member. The insulative member preferably also has a resilient tab having a barb for engaging and retaining the coil thereon. The resilient tabs can be formed between two generally longitudinally extending slots, and the barb projects radially outwardly from the distal end of the tab, having a sloped face on one side for resiliently deflecting the tab when the coil is urged over the tab, and an oppositely facing flat shoulder for engaging and retaining the coil on the insulating member.

Thus the invention allows the inner end of a bi-metal coil to be secured easily in a thermostat, thus eliminating a need for more expensive mounting methods, costly insulating parts, and reducing labor costs. The apparatus also simplifies calibration while reducing costs of assembly and materials.

BRIEF DESCRIPTION OF THE DRAWINGS

Corresponding reference numerals indicate corresponding parts throughout the several views of the drawings.

DETAILED DESCRIPTION OF THE INVENTION

Figure 1:
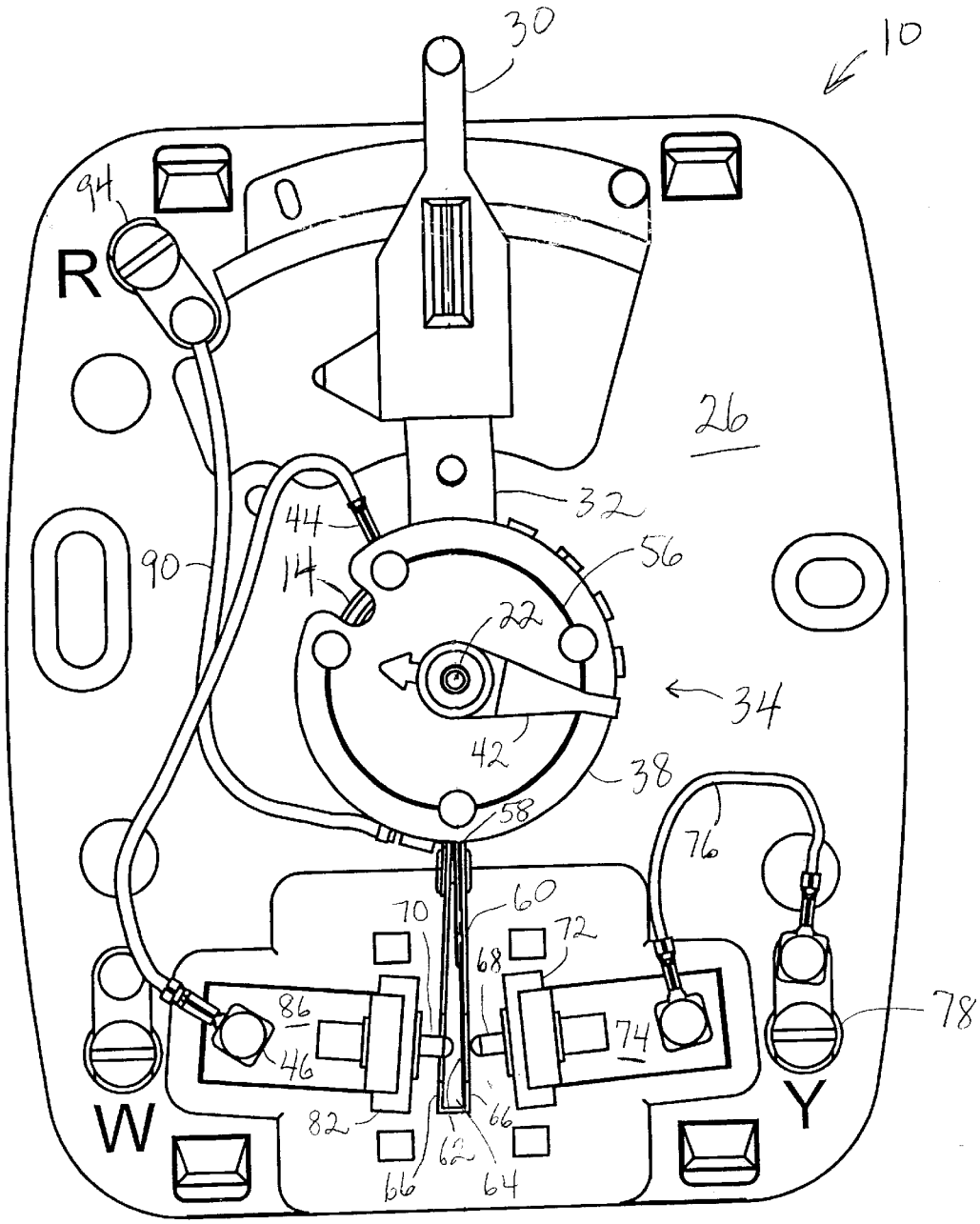
FIG. 1 is a plan view of a thermostat constructed according to the principles of this invention, with the front cover removed.

A thermostat according to one embodiment of the invention, indicated generally as 10 in FIG. 1, is shown with a front cover removed. The thermostat 10 includes a bi-metal coil 14 mounted on an electrically conductive shaft 22. As further described below and in accordance with the present embodiment of the invention, an insulating member 24 (not shown in FIG. 1) mounts and insulates the bi-metal coil 14 from the shaft 22 and fixes the inner end (not shown in FIG. 1) of the coil 14 relative to the shaft 22. Shaft 22 extends through an electrically insulating base 26. A control arm 30 is connected to shaft 22 via a link 32. A user of thermostat 10 moves control arm 30 to select a set-point temperature. Moving the control arm 30 counter clockwise (to the right as shown in FIG. 1) causes the coil 14 to wind about shaft 22. Moving the control arm 30 clockwise (to the left as shown in FIG. 1) causes the coil 14 to unwind about shaft 22.

An anticipator 34 is mounted on shaft 22, in electrical communication. The anticipator 34 includes an insulating disk 38 upon which is mounted an electrically conductive arm 42. The arm 42 is configured to provide a variable resistance between the conductive shaft 22 and an electrical connector 44 connected to a heating circuit terminal 46. More specifically, there is a wire 56 on the surface of the insulating disk 38 that provides an electrical connection between the arm 42 and the contact 44. The resistance of this electrical connection depends upon the length of the wire 56 between the arm and the contact 44. This resistance can be varied by rotating the arm 42 about the shaft 22 to change the point where it contacts the wire 56.

An outer end 58 of coil 14 is connected to a magnetic switching arm 60. Arm 60 is configured to switch thermostat operation between heating and non-heating circuits under control of coil 14 as further described below. Arm 60 includes a switching contact 62 mounted in a slot 64 defined by two sides 66 of arm 60. The arm 60 is configured to move between two contacts 68 and 70 as the coil winds and unwinds due to changes in temperature. Contact 68 is mounted on a magnet 72 and is electrically connected to a conductive bracket 74. Bracket 74 is electrically connected via a wire 76 to a non-heating circuit terminal 78. Contact 70 is mounted on a magnet 82 and is electrically connected to a conductive bracket 86. Bracket 86 is electrically connected to heating circuit terminal 46. Arm 60 also is electrically connected via a wire 90 to a common terminal 94.

The switching contact 62 is positioned to make electrical contact with contact 68 when arm 60 moves into a magnetic field generated by magnet 72. Switching contact 62 is also positioned to make electrical contact with contact 70 when arm 60 moves into a magnetic field generated by magnet 82.

When temperature of the space surrounding the thermostat falls below a set-point temperature, or when a user increases a set-point temperature via control arm 30, coil 14 winds about shaft 22 and causes the arm 60 to move toward the magnet 82. When the contact 62 touches the contact 70, an electrical connection is made between the switch 62 and heating circuit terminal 46.

When the temperature surrounding the thermostat 10 reaches the set-point temperature, or when a user lowers the set-point temperature via control arm 30, the coil 14 unwinds, causing the arm 60 to move toward the magnet 72. When contact 62 touches contact 68, an electrical connection is made between switching contact 62 and the non-heating circuit terminal 78.

Figure 2:
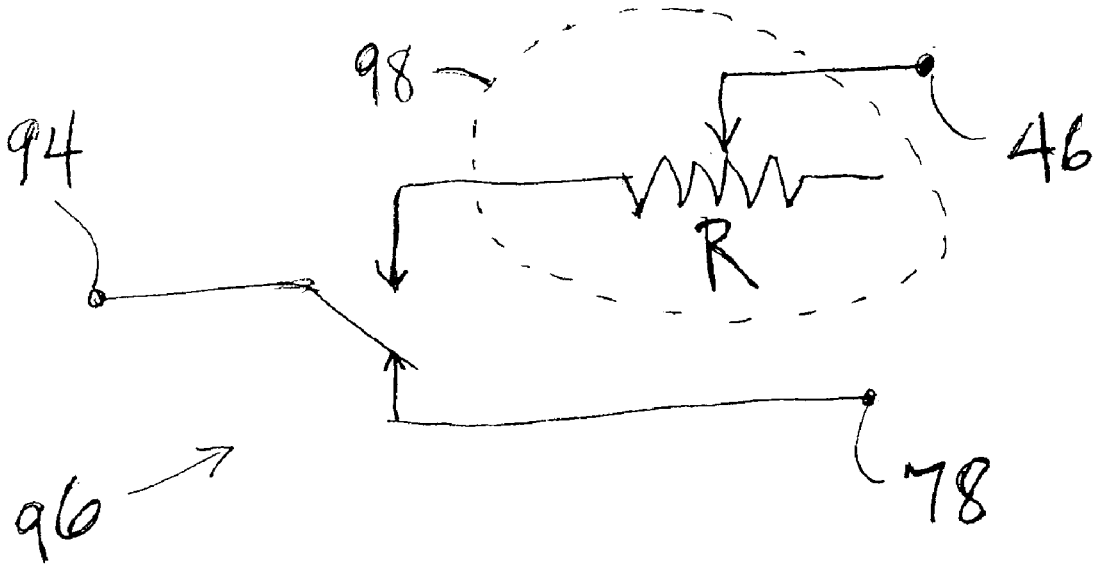
FIG. 2 is a simplified circuit diagram for the thermostat shown in FIG. 1.

A circuit for the thermostat 10 is indicated generally as 96 in FIG. 2. The anticipator 34 operates via a portion of the circuit indicated generally as 98 and referred to herein as the "anticipator circuit". As described above, the anticipator circuit 98 includes a variable resistance R that is introduced in series between the heating terminal 46 and the common terminal 94. A conductive link (not shown) located, for example, on an underside (not shown) of the thermostat base 26, connects the heating terminal 46 to the base (not shown in FIG. 1 or FIG. 2) of the shaft 22. Thus the shaft 22 is integral to the anticipator circuit 98.

Figure 3:
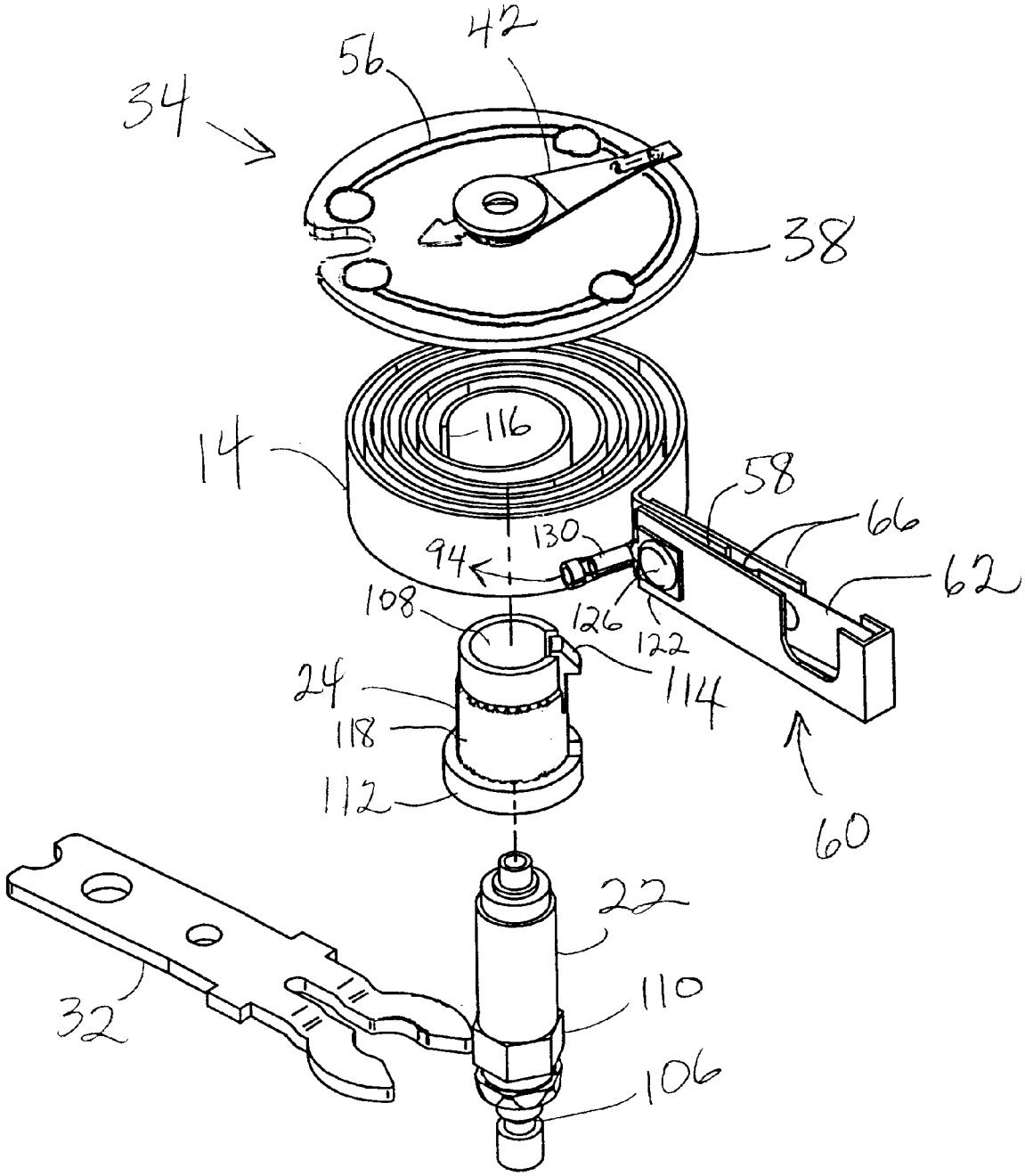
FIG. 3 is an exploded, view of the thermostat, showing the mounting of the bi-metal coil.
Figure 4:
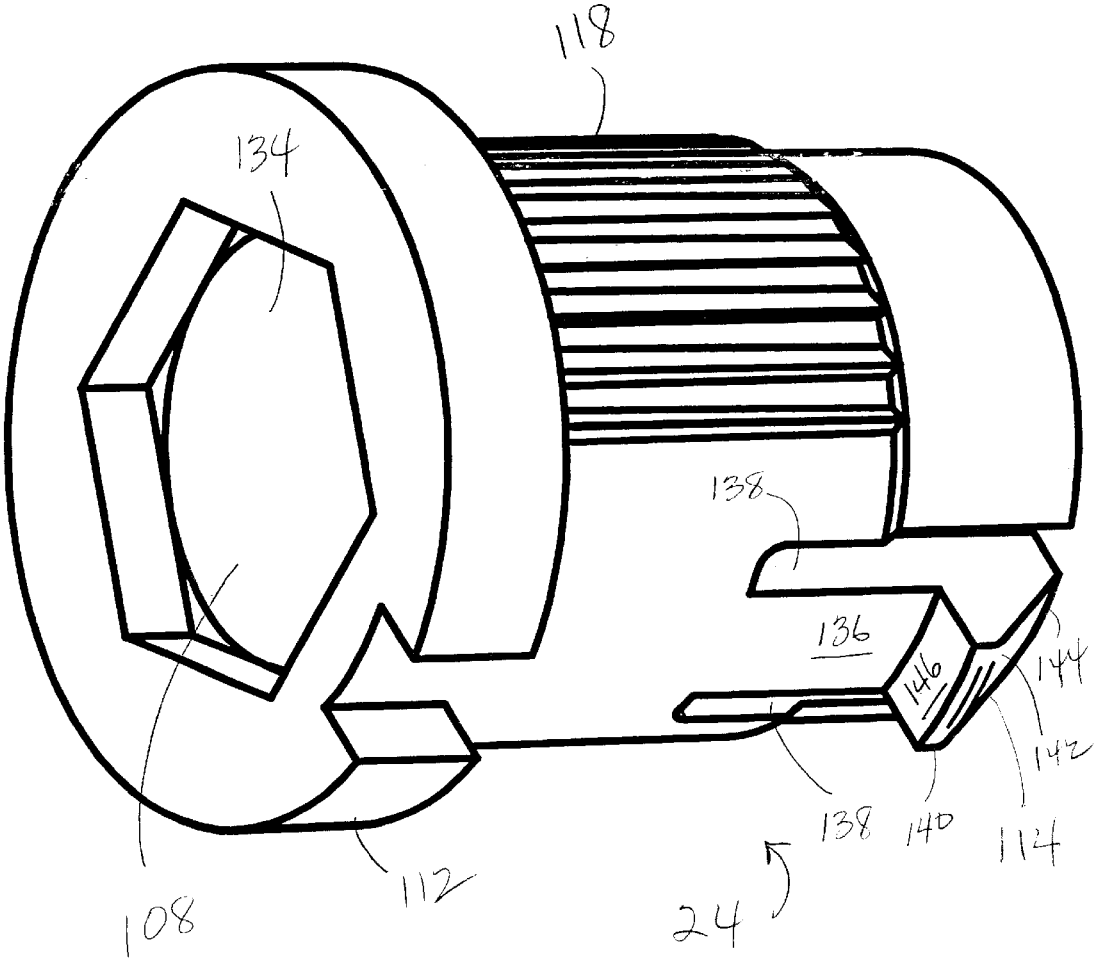
FIG. 4 is a perspective view of a preferred embodiment of insulating member for mounting the bi-metal coil.

An embodiment of insulative member 24 for mounting the coil 14 in a thermostat is shown in FIGS. 3 and 4. Although the insulative member 24 is shown and described in connection with the thermostat 10, it is contemplated that embodiments of the insulative member 24 could be used in other thermostat configurations. An insulative member 24 is configured for mounting between the shaft 22 and the coil 14. The insulative member 24 is fabricated, for example, of a plastic material. The shaft 22 is configured for mounting the insulative member 24 thereon. As previously described, the base 106 of the shaft 22 is configured for electrical connection to a link (not shown) electrically connected to the heating terminal 46.

The insulative member 24 has a bore 108 therethrough configured to fit over and engage the shaft 22, and resist relative rotation. More specifically and as further described below, shaft 22 includes a portion 110 with a surface configured to mate with a corresponding portion on the inner bore. For example. As shown in FIG. 3, the portion 110 of the shaft 22 has a polygonal (hexagonal) shape, and a portion of the bore has a corresponding polygonal shape. Of course other shapes or configurations could be used to engage the shaft 22 and the insulative member 24 from relative rotation.

When the coil 14 is mounted on the insulative member 24, the insulative member 24 insulates the coil 14 from the shaft 22 and the anticipator circuit 98.

The insulative member 24 is configured to maintain the coil 14 in alignment between the anticipator 34 and the thermostat base 26 (shown in FIG. 1). More specifically, a flange 112 extends between the coil 14 and the thermostat base 26. The insulative member 24 also includes a retainer 114 configured for releasably engaging the coil. The retainer 114 comprises a tab 136 formed by two generally parallel longitudinally extending slots 138. A barb 140 projects radially outwardly from the tab 136, and has a sloped surface 142 so that the coil 14 resiliently deflects the tab radially inwardly as the coil is installed on the insulative member 24, and snaps back so that a shoulder formed by the barb engages the coil to retain it on the insulative member, and keeping the coil separated from the anticipator circuit 98. The barb 140 projects radially outwardly from the distal end 144 of the tab, having a sloped face on one side for resiliently deflecting the tab when the coil is urged over the tab, and an oppositely facing flat face 146 forming a shoulder for engaging and retaining the coil 14 on the insulating member 24.

As previously described, the insulative member 24 is restrained from movement relative to the shaft 22 by the engagement between the surface of the portion 110 of the shaft 22 and the bore 108 of the insulative member 24. When mounted on the shaft 22, the insulative member 24 also fixes the inner end 116 of the coil 14 relative to the shaft 22. For example, the surface 118 of the insulative member 24 can be knurled to engage and secure the inner end 116 of the coil 14, and resist movement relative to the insulative member 24. As shown in FIG. 4, the surface 118 may have longitudinally extending v-shaped ridges and valleys.

Alternative or additional means of engaging the end 116 of the bi-metal coil can be used. For example, the surface 118 could include a notch (not shown) in place of, or in addition to, the knurling 118 shown in FIG. 3, configured to receive and fix the inner end 116 of the coil 14. The inner end 116 of the bi-metal coil 14 can be knurled to engage the surface 118 of the insulative member 24.

The inner end 122 of the switching arm 60 includes, for example, a connector 126 for attaching the arm 60 to the outer end 58 of the coil 14. The arm 60 also includes a terminal 130 for connection to the common terminal 94 (shown in FIG. 1 and FIG. 2) via the wire 90 (shown in FIG. 1). The arm 60 is insulated from the anticipator circuit 98 (shown in FIG. 2) via the insulating member 24.

The insulative member 24 is shown in FIG. 4. The bore 108 includes a hexagonal portion 134, which as described above is adapted mate with the surface of portion 110 of the shaft 22 to resist relative rotation. Of course, other mating configurations for the shaft 22 and the insulative member 24 could be used, as well as alternative methods of mounting the insulative member 24 on the shaft 22.

The above-described thermostat 10 and insulating member 24 can be used in an improved method for mounting a bi-metal coil in a thermostat including an anticipator operable via an anticipator circuit. Such method includes mounting the coil on an insulating device configured to insulate the coil from the anticipator circuit, mounting the insulating device on a conductive shaft, and integrating the shaft into the anticipator circuit. The above described method can further include mounting a contact in a slot of a switching arm, and mounting the switching arm on an outer end of the coil for movement of the contact between terminals of the thermostat.

The above described apparatus and methods allow a bimetal coil to be easily secured and electrically isolated from an anticipator circuit in a thermostat. Thermostat design is simplified through use of a simpler bracket assembly and fewer insulating parts. Calibration is improved where the above described insulating device is used instead of techniques such as perma-bonding to isolate the coil. Thus an improved thermostat can be manufactured while costs of assembly and materials are reduced.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A thermostat comprising a base; a conductive shaft extending from the base; an anticipator circuit mounted on, and electrically connected to, the conductive shaft; an electrically insulative member on the conductive shaft between the base and the anticipator circuit; and a temperature-responsive coil on the electrically insulative member electrically isolated from the conductive shaft and anticipator circuit, carrying a conductive switch member.

2. The thermostat according to claim 1 wherein the insulative member has a bore therethrough configured to engage the shaft and resist rotation.

3. The thermostat according to claim 1 wherein at least a portion of the shaft and a portion of the bore through the insulative member have mating configurations to resist relative rotation.

4. The thermostat according to claim 1 wherein the insulative member has an external surface adapted to engage the end of the coil and resist rotation of the coil.

5. The thermostat according to claim 4 wherein insulative member has a plurality of longitudinally extending ridges and valleys on the surface to engage the end of the coil and resist relative rotation.

6. The thermostat according to claim 1 wherein the insulative member has a flange adjacent one end of the insulative member.

7. The thermostat according to claim 1 where the insulative member has a resilient tab having a barb for engaging and retaining the coil thereon.

8. The thermostat according to claim 7 wherein the resilient tabs is formed between two generally longitudinally extending slots, and the barb projects radially outwardly from the distal end of the tab, having a sloped face on one side for resiliently deflecting the tab when the coil is urged over the tab, and an oppositely facing flat shoulder for engaging and retaining the coil on the insulating member.

9. A thermostat comprising a base; a conductive shaft extending from the base; an anticipator circuit mounted on, and electrically connected to, the conductive shaft; an electrically insulative member on the conductive shaft between the base and the anticipator circuit; and a temperature-responsive coil on the electrically insulative member electrically isolated from the conductive shaft and anticipator circuit, carrying a conductive switch member; the insulative member having a bore therethrough configured to engage the shaft and resist rotation.

10. The thermostat according to claim 9 wherein at least a portion of the shaft and a portion of the bore through the insulative member have mating configurations to resist relative rotation.

11. The thermostat according to claim 9 wherein the insulative member has an external surface adapted to engage the end of the coil and resist rotation of the coil.

12. The thermostat according to claim 11 wherein insulative member has a plurality of longitudinally extending ridges and valleys on the surface to engage the end of the coil and resist relative rotation.

13. The thermostat according to claim 9 wherein the insulative member has a flange adjacent one end of the insulative member.

14. The thermostat according to claim 9 where the insulative member has a resilient tab having a barb for engaging and retaining the coil thereon.

15. The thermostat according to claim 9 wherein the resilient tabs is formed between two generally longitudinally extending slots, and the barb projects radially outwardly from the distal end of the tab, having a sloped face on one side for resiliently deflecting the tab when the coil is urged over the tab, and an oppositely facing flat shoulder for engaging and retaining the coil on the insulating member.

16. A thermostat comprising a base; a conductive shaft extending from the base; an anticipator circuit mounted on, and electrically connected to, the conductive shaft; an electrically insulative member on the conductive shaft between the base and the anticipator circuit; and a temperature-responsive coil on the electrically insulative member electrically isolated from the conductive shaft and anticipator circuit, carrying a conductive switch member; the insulative member having a bore therethrough configured to engage the shaft and resist rotation, and having an external surface adapted to engage the end of the coil and resist rotation of the coil, a flange adjacent one end of the insulative member, and a resilient tab having a barb for engaging and retaining the coil thereon.

17. The thermostat according to claim 16 wherein at least a portion of the shaft and a portion of the bore through the insulative member have mating configurations to resist relative rotation.

18. The thermostat according to claim 16 wherein insulative member has a plurality of longitudinally extending ridges and valleys on the surface to engage the end of the coil and resist relative rotation.

19. The thermostat according to claim 16 wherein the resilient tabs is formed between two generally longitudinally extending slots, and the barb projects radially outwardly from the distal end of the tab, having a sloped face on one side for resiliently deflecting the tab when the coil is urged over the tab, and an oppositely facing flat shoulder for engaging and retaining the coil on the insulating member.

20. A thermostat comprising a base; a conductive shaft extending from the base; an anticipator circuit mounted on, and electrically connected to, the conductive shaft; an electrically insulative member on the conductive shaft between the base and the anticipator circuit; and a temperature-responsive coil on the electrically insulative member electrically isolated from the conductive shaft and anticipator circuit, carrying a conductive switch member; the insulative member having a bore therethrough configured to engage the shaft and resist rotation, and having an external surface adapted to engage the end of the coil and resist rotation of the coil, a flange adjacent one end of the insulative member, and a resilient tab having a barb for engaging and retaining the coil thereon.

21. A method of mounting a bi-metal coil in a thermostat having an anticipator circuit that is mounted on, and electrically connected to, a conductive shaft projecting from the base of the thermostat, the method comprising mounting an insulative member on the conductive shaft between the base and the anticipator circuit, and mounting the bi-metal coil on the insulative member, so that the bi-metal coil extends between the thermostat base and the anticipator circuit.

* * * * *